US009541342B1

(12) United States Patent
Blake

(10) Patent No.: US 9,541,342 B1
(45) Date of Patent: Jan. 10, 2017

(54) TRIGGER TRAVEL ADJUSTMENT INSERT

(71) Applicant: Charles D. Blake, Norco, CA (US)

(72) Inventor: Charles D. Blake, Norco, CA (US)

( * ) Notice: Subject to any disclaimer, the term of this patent is extended or adjusted under 35 U.S.C. 154(b) by 0 days.

(21) Appl. No.: 14/815,679

(22) Filed: Jul. 31, 2015

(51) Int. Cl.

| | |
|---|---|
| ***F41A 19/16*** | (2006.01) |
| ***F41A 3/66*** | (2006.01) |
| ***F41A 19/10*** | (2006.01) |
| ***F41A 19/14*** | (2006.01) |

(52) U.S. Cl.
CPC ..... *F41A 19/16* (2013.01); *F41A 3/66* (2013.01); *F41A 19/10* (2013.01); *F41A 19/14* (2013.01)

(58) Field of Classification Search
CPC ..... F41A 19/06–19/54; F41A 3/66
USPC ..... 42/69.01
See application file for complete search history.

(56) References Cited

U.S. PATENT DOCUMENTS 2,249,232 A * 7/1941 Smith ..... F41A 19/16 42/69.02
3,045,555 A * 7/1962 Stoner ..... F41A 19/46 89/142
3,163,951 A * 1/1965 Lewis ..... F41A 19/53 42/59
3,292,492 A * 12/1966 Sturtevant ..... F41A 17/46 89/128
4,679,487 A * 7/1987 Houseman ..... F41A 19/33 42/75.03
4,930,239 A * 6/1990 Hunter ..... F41A 3/82 42/42.01
4,967,501 A * 11/1990 Hunter ..... F41A 19/21 42/69.01
6,640,479 B2 * 11/2003 Guhring ..... F41A 19/16 42/69.03
6,772,548 B1 * 8/2004 Power ..... F41A 19/10 42/69.03
7,421,937 B1 * 9/2008 Gangl ..... F41A 17/46 42/69.03
7,587,851 B1 * 9/2009 Luth ..... F41A 35/02 124/31

OTHER PUBLICATIONS

Metzgeri, Jard Adjustable triggers, Dec. 6, 2008, Surplus Rifle Forum, pp. 1-2.*

(Continued)

*Primary Examiner* — Stephen M Johnson
*Assistant Examiner* — Joshua Semick
(74) *Attorney, Agent, or Firm* — Morland C. Fischer

(57) ABSTRACT

A threaded trigger travel adjustment insert to be located in the existing grip screw hole of a lower receiver commonly associated with a rifle or a pistol to connect the hand grip to the receiver. The trigger travel adjustment insert has a trigger contact tip at one end thereof for receipt within the fire control cavity of the lower receiver at which to contact the trigger tang of the weapon. Rotating the threaded trigger travel adjustment insert through the grip screw hole causes the trigger contact tip of the insert to elevate the trigger tang resulting in a corresponding reduction in the overlap between the trigger sear and the hammer sear notch prior to the trigger being pulled. Accordingly, the distance traveled by the trigger through the fire control cavity after the trigger is pulled and released is advantageously shortened to improve trigger predictability and reliably, thereby facilitating improved accuracy.

4 Claims, 2 Drawing Sheets

(56) References Cited

OTHER PUBLICATIONS

Superior Arms, undated drawing plus online posting at www.ar15.com dated Jan. 2, 2006 for a trigger adjustment screw, Model S-15.
Superior Arms, image posted online at www.ar15trigger.adjuster.com and text bearing 2013 copyright notice for AR15 Trigger Adjuster.

* cited by examiner 5
5
10
12
13
14
16
17
18
20
22
24
26
28
30
32
40
42

TRIGGER TRAVEL ADJUSTMENT INSERT

BACKGROUND OF THE INVENTION

1. Field of the Invention

This invention relates to a trigger travel adjustment insert to be located in the existing grip screw hole of a lower receiver that is commonly associated with the AR 15, or similar weapons platforms. The trigger travel adjustment insert has a trigger contact tip at one end thereof which is located in contact with the trigger, thereby establishing the home position to which the trigger will return after the trigger has been pulled to fire the weapon. Adjustment of the trigger travel adjustment insert towards the trigger correspondingly reduces the length of the trigger pull required to release the hammer and fire the weapon. The trigger travel adjustment insert facilitates improved shooter accuracy by promoting predictable and reliable hammer release and subsequent discharge of the weapon.

2. Background Art

In the case of a shooter aiming and firing a rifle or a pistol, accuracy is significantly influenced by the predictability of trigger function, specifically in terms of trigger pull distance and the force required by the shooter to actuate the trigger. Once a trigger has been actuated to the point of hammer release, i.e., the break point, the trigger may be released at which time it will travel backwards, at a minimum to the point of trigger reset, at which point the trigger may again be actuated to fire the weapon. Excessive backward travel, beyond the point of trigger reset, is undesirable and only serves to lengthen trigger pull distance and add to inconsistency of trigger function. Under normal conditions, trigger backward travel, beyond the point of trigger reset, is limited either by the full depth of trigger sear engagement into the opposing hammer sear notch or by interference between the trigger tang and the floor of the fire-control cavity, whichever occurs first.

Accordingly, it is desirable to be able to selectively adjust and shorten the length of the trigger pull required to fire the weapon and also limit the backward travel of the trigger once it is released and permitted to travel minimally beyond the point of trigger reset (i.e., the home position) in order to improve both trigger function and shooter accuracy.

SUMMARY OF THE INVENTION

In general terms, a trigger travel adjustment insert is disclosed herein that is capable of being detachably connected to the lower receiver of a pistol or a rifle to contact the trigger and establish a point of registration for the trigger within the fire control cavity to which the trigger will return after being pulled. The trigger travel adjustment insert has an elongated screw threaded body with a trigger contacting tip at one end thereof. Once the conventional grip screw has been removed from the lower receiver of the weapon, the threaded body of the insert is rotated through the existing grip screw hole, creating a post onto which the grip can be installed and secured. At the same time, the trigger contacting tip which extends from the threaded body of the trigger travel adjustment insert contacts the trigger tang to establish a point of registration for the trigger within the fire control cavity thereby serving as a trigger return stop to limit the backward travel of the trigger once it has been pulled and released.

By virtue of the tip of the trigger contacting tip of the trigger travel adjustment insert contacting the trigger tang, a lifting force is applied to elevate the trigger tang towards the safety selector cam within the fire control cavity. Accordingly, the trigger is rotated relative to the hammer to reduce the depth and engagement of the trigger sear into the hammer sear notch within which the trigger sear is received prior to the trigger being pulled. Therefore, both the trigger and the trigger sear are required to travel a shorter distance before the trigger sear is fully disengaged from the hammer sear notch to permit the hammer to be released and the weapon to be fired. The shorter pull distance of the trigger results in improved consistency and better shooter accuracy.

DESCRIPTION OF THE PREFERRED EMBODIMENT

Figure 1:
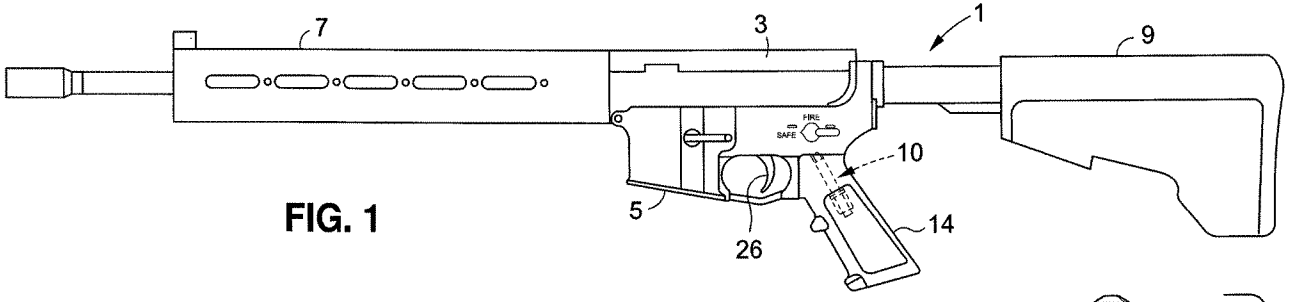
FIG. 1 shows a rifle of the kind with which the trigger travel adjustment insert of this invention has application.

A trigger travel adjustment insert 10 according to a preferred embodiment of this invention is described while referring concurrently to FIGS. 1-5 of the drawings. The advantages of this invention are particularly applicable to a rifle such as that shown in FIG. 1 which generally includes upper and lower receivers 3 and 5 detachably connected at one end thereof to a barrel and handguard 7 and at the opposite end to a buffer tube 1 and a shoulder rest or butt 9. By way of example only, the trigger travel adjustment insert 10 can be used with the AR15, M16, AR10, and similar weapons platforms. It is to be understood that the trigger travel adjustment insert 10 can also be used in handguns that are based on the stated platforms.

Figure 2:
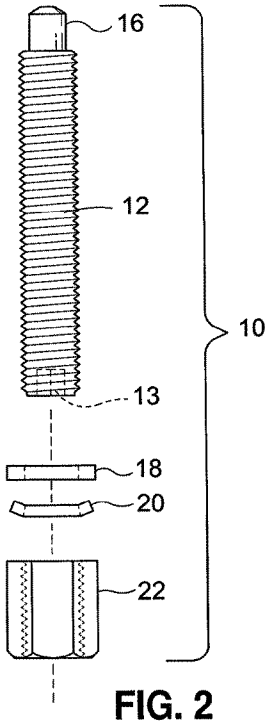
FIG. 2 is an enlarged illustration of the trigger travel adjustment insert and its fastening hardware in accordance with a preferred embodiment of this invention.

As is best shown in FIG. 2, the trigger adjustment insert 10 has an elongated screw threaded body 12 so as to be capable of replacing a conventional threaded grip screw that is typically used to detachably connect the hand grip 14 of the rifle or pistol to the lower receiver 5. The length of the threaded body 12 will vary depending upon the rifle or pistol with which it is used. A relatively short (e.g., about 0.23 inches) trigger contacting tip 16 lies at one end of the threaded body 12 of the adjustment insert 10. The trigger contacting tip 16 need not be threaded. For the purpose of facilitating its installation or removal, the threaded body 12 of the trigger travel adjustment insert 10 has a hex-shaped cavity 13 so that a rotational force can be imparted thereto by a suitably dimensioned (e.g., ⅛ inch) tool (best shown in FIG. 3).

Referring particularly to FIGS. 2-5 of the drawings, the trigger travel adjustment insert 10 is shown located within a hollow hand grip 14 after the conventional threaded grip screw has first been removed. The adjustment insert 10 of this invention which is longer than the conventional grip screw performs two functions. The first function is simply to serve as a post onto which the grip 14 is installed and by which the grip 14 is secured to the bottom of the lower receiver 5 similar to the function performed by the conventional grip screw. That is, a rotational force applied to the insert 10 (at cavity 13) causes the threaded body 12 thereof to rotate inwardly and into mating engagement with the existing and correspondingly threaded grip screw hole (designated 17 in FIG. 3). To hold the trigger travel adjustment insert 10 in place and prevent a detachment of the grip 14 from the bottom of the lower receiver 5, a flat washer 18 followed by a serrated spring-like washer 20 and a hex nut 22 are rotated into surrounding engagement with and moved axially along the threaded body 12 of the trigger travel adjustment insert 10. Other suitable fasteners may also be used in place of washers 18 and 20 and hex nut 22.

The second function to be performed by the trigger travel adjustment insert 10 is to establish a point of registration for the trigger 26 within the fire-control cavity 30 of the lower receiver 5 so as to reduce the length of the trigger pull required to fire the weapon. To accomplish the foregoing function, the trigger travel adjustment insert 10 must have a length that is sufficient to enable the trigger contacting tip 16 at the end of the threaded body 12 to engage the bottom of the trigger tang 24 at the rear end thereof opposite the safety selector cam 28. It may be appreciated in this regard that the aforementioned first and second functions are performed by the same threaded insert 10 received through the same threaded grip screw hole 17.

The safety selector cam 28 is standard in most weapons and functions to prevent an unintended discharge of the weapon. In addition, the safety selector cam 28 is located in the fire control cavity 30 to limit any over rotation of the trigger tang 24 excessively beyond the break-point. With the addition of the trigger travel insert 10 of this invention, the travel of the trigger tang 24 following a trigger pull is limited to the distance between the trigger contacting tip 16 of insert 10 and the safety selector cam 28.

The trigger 26 extends downwardly and outwardly from the lower receiver 5 so as to be manually accessible to a user. The trigger 26 is pivotally connected to the lower receiver 5 within the fire control cavity 30. The trigger 26 functions cooperatively with the usual hammer 32 within the fire control cavity 30. A pulling force applied by the user causes the trigger 26 to rotate in a counter-clockwise direction and the trigger tang 24 to simultaneously move upwardly within the fire control cavity 30 towards the safety selector cam 28 that is first rotated by the usual safety selector lever (not shown) to enable the weapon to be fired. A rotation of the trigger 26 to the point where the hammer 32 is released permits a corresponding rotation of the hammer 32 in the same counter-clockwise direction propelled by the force of the hammer spring (not shown).

Prior to the trigger 26 being pulled to fire the weapon, the trigger sear 40 is received within and engaged by the usual hammer sear notch 42 formed in the hammer 32. When the trigger 26 is pulled and the trigger tang 24 is rotated upwardly within the fire-control cavity, the trigger sear 40 rotates downwardly to become disengaged from the notch 42. By virtue of the trigger contacting tip 16 of the trigger travel adjustment insert 10 applying a lifting force to elevate the rear end of the trigger tang 24, the trigger sear 40 is correspondingly positioned to reduce the degree of engagement (i.e., overlap) between the trigger sear 40 and the hammer sear notch 42 within which the trigger sear 40 is received. Therefore, when the trigger 26 has been pulled, the trigger sear 40 is required to travel a shorter distance before it is fully disengaged from the hammer sear notch 42 to permit the hammer 32 to be released and the weapon to be fired. In other words, the pull distance of the trigger 26 is advantageously shortened.

Figures 3, 4:
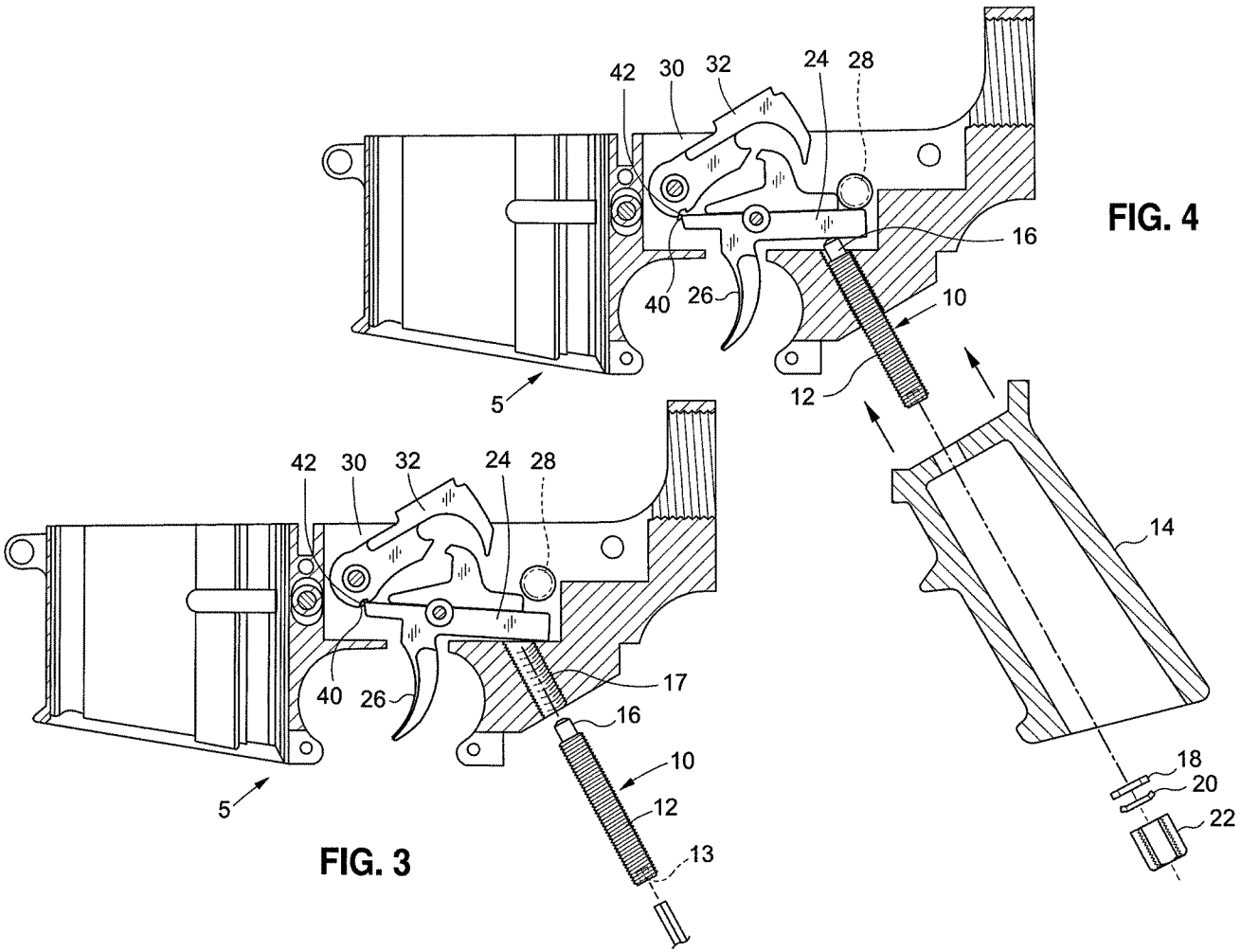
FIG. 3 shows the trigger travel adjustment insert of FIG. 2 aligned so as to be removably received by the existing threaded grip hole formed in the lower receiver of the rifle of FIG. 1.
FIG. 4 is an exploded view showing the grip to be connected to the lower receiver of the rifle shown in FIG. 1 when the trigger travel adjustment insert is received by the threaded grip hole in the lower receiver to create a mounting post for the grip.

Had the adjustable trigger insert 10 of this invention not been present to contact and elevate the trigger tang 24 of trigger 26, as in the case when a conventional grip screw is used to connect the hand grip 14 to the lower receiver 5, the rear end of the trigger tang 24 of the trigger 26 may lie at or near the floor of the fire control cavity 30 so as to be spaced farther below the safety selector cam 28 (best shown in FIG. 3). In this case, there will be a greater degree of engagement (i.e., overlap) between the trigger sear 40 and the hammer sear notch 42. Consequently, when the trigger is pulled to the point where the hammer 32 is released, the pull distance is notably greater which detracts from trigger function and reliability and shooting accuracy.

Figure 5:
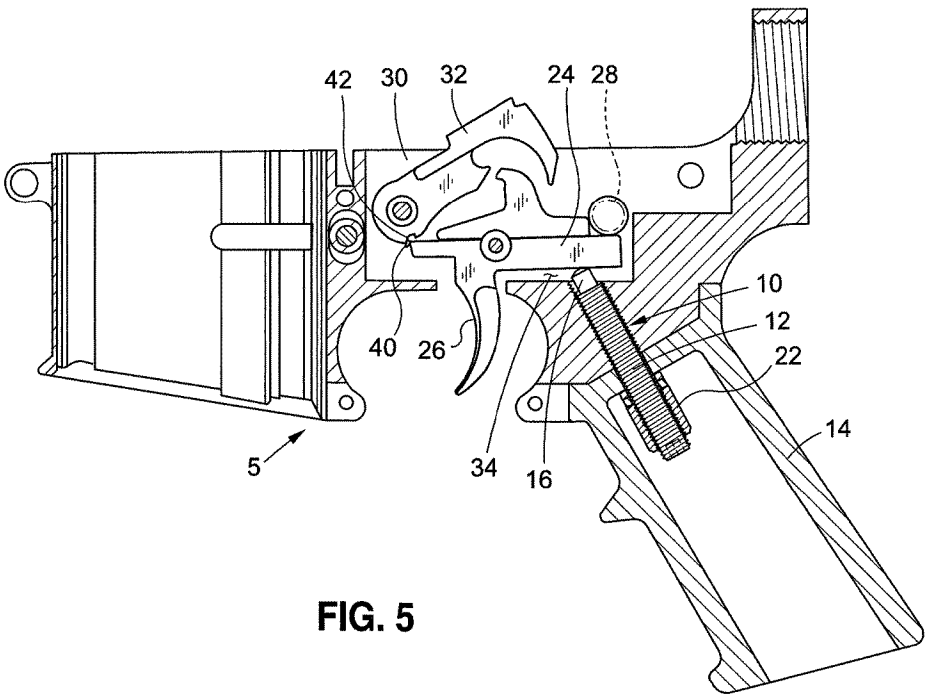
FIG. 5 shows the grip attached to the lower receiver and the tip of the trigger travel adjustment insert moved into contact with the trigger tang within the fire control cavity of the lower receiver to support and elevate the trigger tang towards the safety selector cam resulting in reduced engagement of the trigger sear into the hammer sear notch.

As a result of the improvement provided by the inclusion of the trigger travel adjustment insert 10 to detachably connect the grip 14 to the lower receiver 5, the aforementioned distance covered by the trigger tang 24 of the trigger 26 through the fire control cavity 30 in response to the application of a pulling force to the trigger 26 is advantageously reduced. More particularly, with the threaded body 12 of the trigger travel adjustment insert 10 received through the single threaded grip screw hole 17 formed in the lower receiver 5, the trigger contacting tip 16 at the end of the threaded body 12 establishes a point of registration for the trigger tang 24 of the trigger 26. Accordingly, and as is best shown in FIG. 5, the trigger tang 24 of the trigger 26 is supported upwardly within the fire control cavity 30 and optimally positioned relative to the safety selector cam 28 so as to correspondingly increase the clearance space 34 (best shown in FIG. 5) between the floor of the fire-control cavity 30 and the trigger tang 24. Thus, when the trigger 26 is rotated and subsequently released, the total distance traveled by the trigger tang 24 back to its home position when the trigger tang 24 is stopped by its engagement with the contacting tip 16 of the trigger travel adjustment insert 10, is shortened. With a shorter recovery path along which to travel, the trigger 24 will more quickly return to its home position as determined by the point of registration established by the position of the extended tip 16 of the trigger travel adjustment insert 10 within the fire-control cavity 30. Accordingly, length of trigger pull is minimized and accuracy of the weapon is advantageously increased.

What is even more, the length of trigger pull, as determined by the addition of the trigger travel adjustment insert 10, can be selectively adjusted by changing the depth of insertion of the threaded body 12 into the threaded grip screw hole 17 such that the trigger contacting tip 16 contacts and supports the trigger tang 24 at any optimal elevation within the fire control cavity 30 as determined by the user.

The invention claimed is:

1. A combination comprising:

a weapon for firing projectiles, said weapon including an upper receiver, a lower receiver having a fire control cavity, a threaded screw hole formed through the lower receiver which communicates with the fire control cavity, to hammer, and a trigger that is located in the fire control cavity and engages the hammer prior to a pulling force being applied to the trigger, said trigger having a home position and moving through a distance within the fire control cavity away from its home position after a pulling force is applied to the trigger to cause a projectile to be fired from the weapon;

a hollow hand grip to be detachably connected to the lower receiver of said weapon, said hollow hand grip having a hole formed therein that is axially aligned with the threaded screw hole formed through said lower receiver when said hollow hand grip is detachably connected to said lower receiver;

a threaded trigger travel adjustment insert having first and opposite ends and located at the first end thereof through the threaded screw hole formed in said lower receiver and into the fire control cavity at which to contact and elevate the trigger and thereby shorten the distance to be traveled by the trigger within the fire control cavity for the trigger to return to its home position at which to receive another pulling force for causing another projectile to be fired from the weapon, the opposite end of said threaded trigger travel adjustment insert being removably received through the hole formed in said hollow hand grip so that said threaded trigger travel insert establishes a post to which said hollow hand grip can be connected; and a threaded hex nut located inwardly of said hollow hand grip and responsive to a rotational force applied thereto in a first direction by which to engage the opposite end of said threaded trigger travel adjustment insert, whereby said hollow handle grip is detachably connected to said lower receiver at the same time that the first end of said trigger travel adjustment insert contacts and elevates the trigger, said threaded hex nut being responsive to a rotational force applied thereto in an opposite direction so as to be disengaged from the opposite end of said threaded trigger travel adjustment insert so that said hollow handle grip can be detached from said lower receiver and separated from said threaded trigger travel insert without first having to remove said threaded trigger travel adjustment insert from the threaded screw hole formed in the lower receiver.

2. The combination recited in claim 1, wherein said threaded trigger travel adjustment insert has as trigger contacting tip at the first end thereof for receipt within the fire control cavity of the lower receiver of said weapon at which to contact and elevate the trigger when said first end extends through the threaded screw hole formed in the lower receiver.

3. The combination recited in claim 2, wherein said threaded trigger travel adjustment insert is responsive to a rotational force applied thereto for causing said trigger travel adjustment insert to move axially through the threaded screw hole formed in the lower receiver of said weapon and the trigger contacting tip of said insert to contact the trigger within the fire control cavity of the lower receiver to position and advance the trigger within the fire control cavity in order to reduce the overlap between the trigger sear and a notch formed in the hammer at which the trigger sear is engaged prior to the pulling force being applied to the trigger so as to shorten the distance to be traveled by the trigger to the point of disengagement of the trigger sear from the hammer notch upon application of a pulling force to the trigger.

4. The combination recited in claim 2, wherein said weapon also includes a safety selector cam located within the fire control cavity of the lower receiver to prevent an unintended discharge of the weapon, the trigger contacting tip of said threaded trigger travel adjustment insert supporting and elevating a portion of the trigger of said weapon towards said safety selector cam to shorten the distance to be traveled by the trigger to return to its home position after said weapon has first been fired and the trigger has then been released.

* * * * *